US010716332B2

(12) United States Patent
Biel et al.

(10) Patent No.: US 10,716,332 B2
(45) Date of Patent: Jul. 21, 2020

(54) LIQUID RESERVOIR WITH TWO STORAGE VOLUMES AND ATOMIZER/LIQUID RESERVOIR PORTION AS WELL AS ELECTRONIC SMOKING DEVICE WITH LIQUID RESERVOIR

(71) Applicant: Fontem Holdings 1 B.V., Amsterdam (NL)

(72) Inventors: Stefan Biel, Hamburg (DE); Vaclav Borkovec, Hamburg (DE); Neha Daryani, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 211 days.

(21) Appl. No.: 15/756,438

(22) PCT Filed: Aug. 22, 2016

(86) PCT No.: PCT/EP2016/069766

§ 371 (c)(1),
(2) Date: Feb. 28, 2018

(87) PCT Pub. No.: WO2017/036828

PCT Pub. Date: Mar. 9, 2017

(65) Prior Publication Data

US 2018/0235280 A1 Aug. 23, 2018

(30) Foreign Application Priority Data

Aug. 28, 2015 (EP) ..... 15183011

(51) Int. Cl.
*A24F 13/00* (2006.01)
*A24F 17/00* (2006.01)
(Continued)

(52) U.S. Cl.
CPC ..... *A24F 47/008* (2013.01); *A24B 15/167* (2016.11); *H05B 1/00* (2013.01)

(58) Field of Classification Search
CPC .... A24F 47/008; A24F 47/002; A24B 15/167; H05B 1/00
(Continued)

(56) References Cited

U.S. PATENT DOCUMENTS 9,004,073 B2 * 4/2015 Tucker ..... A61M 15/06 131/273
9,877,511 B2 * 1/2018 Li ..... A24F 47/008
(Continued)

FOREIGN PATENT DOCUMENTS

WO 2015038981 A2 3/2015

*Primary Examiner* — Hae Moon Hyeon
(74) *Attorney, Agent, or Firm* — Dykema Gossett PLLC

(57) ABSTRACT

The invention relates to a liquid reservoir (34) for an electronic smoking device (10), an atomizer/liquid reservoir portion (14) with a liquid reservoir (34) for an electronic smoking device (10) and to an electronic smoking device (10) with a liquid reservoir (34). In order to be able to provide gaseous material that has not been atomized by an atomizer (26) of the electronic smoking device (10), the liquid reservoir (34) comprises first and second storage volumes (40, 42) that are each in communication with a liquid outlet (46) or a fluid outlet (50), wherein the liquid outlet (46) and the fluid outlet (50) are arranged one after the other in a longitudinal direction (L) of the liquid reservoir (34).

20 Claims, 3 Drawing Sheets

(51) Int. Cl.

| | |
|---|---|
| ***A24F 25/00*** | (2006.01) |
| ***A24F 47/00*** | (2020.01) |
| ***A24B 15/167*** | (2020.01) |
| *H05B 1/00* | (2006.01) |

(58) Field of Classification Search
USPC ..... 131/329, 328
See application file for complete search history.

(56) References Cited

U.S. PATENT DOCUMENTS

| | | | | |
|---|---|---|---|---|
| 9,888,714 | B2 * | 2/2018 | Cameron | A24F 1/30 |
| 9,888,724 | B2 * | 2/2018 | Cameron | A24F 47/008 |
| 10,426,199 | B2 * | 10/2019 | Turner | A61M 15/06 |
| 2014/0000638 | A1 * | 1/2014 | Sebastian | A24F 47/008 131/328 |
| 2014/0261488 | A1 * | 9/2014 | Tucker | A24F 47/008 131/328 |
| 2015/0020822 | A1 | 1/2015 | Janardhan et al. | |
| 2015/0027454 | A1 * | 1/2015 | Li | A24F 47/008 131/328 |
| 2015/0059779 | A1 * | 3/2015 | Alarcon | A24F 47/008 131/273 |
| 2016/0095356 | A1 * | 4/2016 | Chan | A24F 47/008 131/329 |
| 2016/0324212 | A1 * | 11/2016 | Cameron | A24F 47/008 |
| 2018/0242637 | A1 * | 8/2018 | Borkovec | A24B 15/167 |
| 2018/0249762 | A1 * | 9/2018 | Daryani | A24F 47/008 |

* cited by examiner

LIQUID RESERVOIR WITH TWO STORAGE VOLUMES AND ATOMIZER/LIQUID RESERVOIR PORTION AS WELL AS ELECTRONIC SMOKING DEVICE WITH LIQUID RESERVOIR

FIELD OF INVENTION

The present invention relates generally to liquid reservoirs for electronic smoking devices, atomizer/liquid reservoir portions for electronic smoking devices and electronic smoking devices, in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic smoking devices, an airflow sensor is provided within the electronic smoking device which detects a user puffing on the device (e.g., by sensing an under-pressure or an air flow pattern through the device). The airflow sensor indicates or signals the puff to the control electronics to power up the device and generate vapor. In other electronic smoking devices, a switch is used to power up the electronic smoking device to generate a puff of vapor.

It is known to provide based liquids to be atomized with an electronic smoking device with a flavor.

SUMMARY OF THE INVENTION

In accordance with one aspect of the present invention there is provided a liquid reservoir for an electronic smoking device. The liquid reservoir comprises a first storage volume and a second storage volume. The first and the second storage volumes are separated from each other in liquid-tight manner. The liquid reservoir comprises a liquid outlet that is adapted to be coupled to an atomizer for an electronic smoking device. The liquid outlet is in communication with the first storage volume. Furthermore, the liquid reservoir comprises a fluid outlet that is in communication with the second storage volume. The liquid outlet and the fluid outlet are arranged on the same lateral surface of the liquid reservoir and at a distance to each other in a longitudinal direction of the liquid reservoir.

In accordance with another aspect of the present invention there is provided an atomizer/liquid reservoir portion comprising an atomizer for atomizing liquid, and a liquid reservoir for storing liquid to be atomized by the atomizer. The liquid reservoir is a liquid reservoir according to the one aspect of the present invention. In accordance with yet another aspect of the present invention there is provided an electronic smoking device comprising a liquid reservoir according to the one aspect or an atomizer/liquid reservoir portion according to the other aspect of the present invention.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
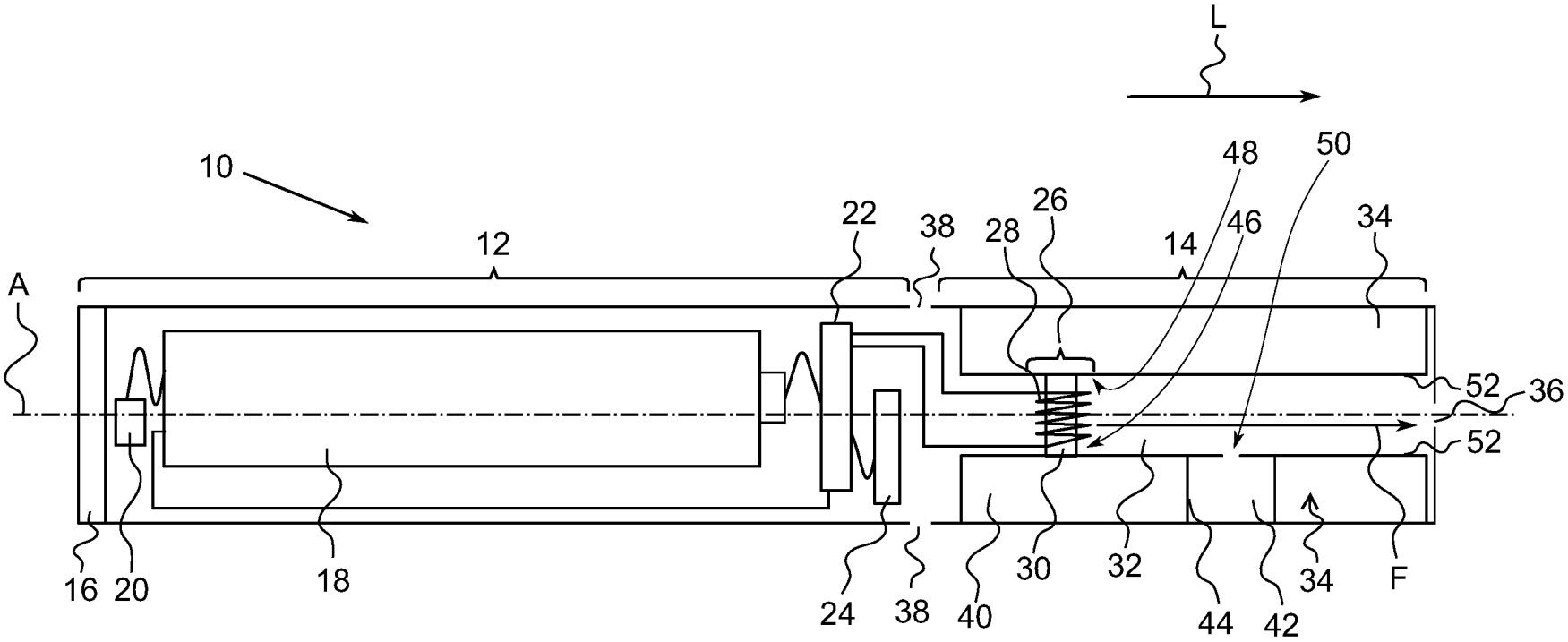
FIG. 1 is a schematic cross-sectional illustration of an exemplary embodiment of an electronic smoking device.

Throughout the following, an electronic smoking device maybe an e-cigarette. As is shown in FIG. 1, an electronic smoking device 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Together, the battery portion 12 and the atomizer/liquid reservoir portion 14 form a cylindrical tube which may be of approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of metal, e.g. aluminum or steel, or of hardwearing plastic and act together with the end cap 16 to provide a housing to contain the components of the electronic smoking device 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, the light-emitting diode 20, control electronics 22 and optionally an airflow sensor 24 are provided within the cylindrical hollow tube battery portion 12. The battery 18 is electrically connected to the control electronics 22, which are electrically connected to the light-emitting diode 20 and the airflow sensor 24. In this example the light-emitting diode 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26 for atomizing liquid to be inhaled. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and the heating coil 28 do not completely block the central passage 32. Rather, an air gap is provided on either end or side of the heating coil 28 enabling air to flow past the heating coil 28 and the wick 30. The atomizer may alternatively use other forms of heating elements, such as ceramic heaters, or fiber or mesh material heaters. Non-resistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the electronic smoking device 10. This causes air to be drawn into the electronic smoking device 10 via one or more air inlets, such as air inlets 38, and to be drawn through the central passage 32 towards the air inhalation port 36. The change in air pressure which arises is detected by the airflow sensor 24 which generates an electrical signal that is passed to the control electronics 22. In response to the signal, the control electronics 22 activate the heating coil 28 which causes liquid present in the wick 30 to be vaporized creating an aerosol (which may comprise gaseous and liquid components) within the central passage 32. As the user continues to suck on the electronic smoking device 10, this aerosol is drawn through the central passage 32 and inhaled by the user. At the same time the control electronics 22 also activate the light-emitting diode 20 causing the light-emitting diode 20 to light up which is visible via the translucent end cap 16 mimicking the appearance of a glowing ember at the end of a conventional smoking article, e.g. a cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34 after which the electronic smoking device 10 is thrown away. In other embodiments the battery 18 is replaceable or rechargeable and the liquid reservoir 34 is replaceable or refillable. In the cases where the liquid reservoir 34 is a toroidal cavity, this may be achieved by refilling the liquid reservoir 34 via a refill port. In other embodiments the atomizer/liquid reservoir portion 14 of the electronic smoking device 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer or a clearomizer.

The replacement liquid reservoir 34 may be in the form of a cartridge having a central passage 32 through which a user inhales aerosol. In other embodiments, aerosol may flow around the exterior of the liquid reservoir 34 to an air inhalation port 36.

Of course, in addition to the above description of the structure and function of a typical electronic smoking device 10, variations also exist. For example, the light-emitting diode 20 may be omitted. The airflow sensor 24 may be placed adjacent the end cap 16 rather than in the middle of the electronic smoking device. The airflow sensor 24 may be replaced with a switch which enables a user to activate the electronic smoking device manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

The liquid reservoir 34 is shown in FIG. 1 arranged in the atomizer/liquid reservoir portion 14, which is connected to the battery portion 12 to form the electronic smoking device 10.

The liquid reservoir 34 comprises a first storage volume 40 and a second storage volume 42 that are separated from each other in a liquid-tight manner. For example, the first storage volume 40 and the second storage volume 42 are separated from each other in the liquid-tight manner by side walls 44, which is made of a liquid-tight material, e.g. a plastic.

The second storage volume 42 can be a free second storage volume, which stores liquid without additional storage material, for example a sponge material or wadding, being present in the second storage volume 42. Alternatively, the second storage volume 42 can comprise additional storage material, for example a sponge material or wadding, in which the liquid is stored. The liquid reservoir 34 comprises a liquid outlet 46 that is adapted to be coupled to the atomizer 26 for the electronic smoking device 10 in a liquid-transmitting manner. The liquid outlet 46 is in communication with the first storage volume 40, such that liquid stored in the first storage volume 40 can be transmitted from the first storage volume 40 to the atomizer 26 via the liquid outlet 46. The liquid reservoir 34 is shown with two liquid outlets 46, 48, via which liquid can be transmitted from the first storage volume 40 to the atomizer 26 and in particular to the wick 30 of the atomizer 26. For example, the wick 30 extends at least into the liquid outlet 46 or, in case two liquid outlets 46, 48 are provided, into both of the liquid outlets 46, 48.

The liquid reservoir 34 of the exemplary embodiment of FIG. 1 furthermore comprises a fluid outlet 50 that is in communication with the second storage volume 42. The fluid outlet is adapted to let gas or aerosol flow freely from the second storage volume 42 into the central passage 32. In particular, the fluid outlet 50 is not connected to any atomizer in a fluid- or liquid-transmitting manner, but freely releases gaseous or aerosol particles into the central passage 32. Hence, the liquid outlet 46 and the fluid outlet 50 both open into the central passage 32.

The liquid outlet 46 and optionally the liquid outlets 46, 48 and the fluid outlet 50 are arranged on the same lateral surface 52 of the liquid reservoir 34. In the exemplary embodiment of FIG. 1, the lateral surface 52 is an inner lateral surface 52 that borders on the central passage 32. Alternatively, in case the liquid reservoir 34 is not provided with a central passage 32, the lateral surface 52 borders on a flow path F for atomized liquid that flows from the atomizer 26 to the air inhalation port 36 when a user of the electronic smoking device 10 puffs on the electronic smoking device 10.

The liquid outlet 46 or the liquid outlets 46, 48 and the fluid outlet 50 are arranged at a distance to each other in a longitudinal direction L of the liquid reservoir 34. At least a section of the lateral surface 52, the central passage 32 and/or a part of the flow path F extends along the longitudinal direction L. The longitudinal direction L of the liquid reservoir 34 may extend parallel to a central axis A of the electronic smoking device 10.

The lateral surface 52 of the exemplary embodiment of FIG. 1 is plane or flush and extends completely parallel to the longitudinal direction L, such that the central passage 32 has a constant diameter perpendicular to the longitudinal direction L, thereby facilitating producibility of the liquid reservoir 34

In case the liquid reservoir 34 is provided separately from other components of the electronic smoking device 10 or of the atomizer/liquid reservoir portion 14, the central passage 32 may be designated as a center through hole that extends along the longitudinal direction L. The lateral surface 52 is then a lateral surface 52 that adjoins the center through hole.

The liquid reservoir 34 may be filled at least partially with a liquid to be atomized and an 30 additive, e.g. a flavor. The first storage volume 40 comprises the liquid to be atomized by the electronic smoking device 10. The second storage volume 42 comprises the additive to be added to the atomized liquid.

The additive may comprise compounds with a volatility higher than water and for example higher than the liquid to be atomized. For example, the compounds of the additive may have an evaporation number less than 10, less than 8, less than 5, less than 2.5, and for example of 8.3. Alternatively, the compounds of the additive may have an evaporation rate greater than 3, greater than 5 or greater than 8, for example an evaporation rate of 3.8.

Furthermore, the additive may comprise a flavored material and/or nicotine, wherein the flavored material and/or the nicotine exits the second storage volume 42 at room temperature and under ambient pressure by evaporation without heating or other action of the atomizer 26 or of another atomizer.

The flavored materials are for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavouring materials, such as anethole, limonene, linalool, eugenol and the like or hydrophilic flavour components such as a leaf tobacco extract or natural plant flavouring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavoured materials as mentioned above into new flavoured materials. Moreover, it is possible to adsorb any flavour onto a solid material and to use this material as flavoured material within an electronic smoking device according to the present invention.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or of the aroma compound of the compounds of the additive may have evaporation numbers between 3.8 and 10. In general, aroma compounds are highly volatile and this is the reason why we can smell them at room temperature. In case the flavor and/or the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The fluid outlet 50 is shown arranged between the liquid outlet 46 or the liquid outlets 46, 48 and the air inhalation port 36 along a flow path F for atomized liquids, the flow path extending from the atomizer 26 to the air inhalation port 36. For example, the flow path F can at least partly or even completely extend along the longitudinal direction L. Hence, the fluid outlet 50 is arranged downstream of the atomizer 26 along the flow path F.

The lateral surface 52 at least section-wise defines the flow path F for the atomized liquid. The flow path F extends to the air inhalation port 36, e.g. from the atomizer 26, wherein the fluid outlet 50 is arranged downstream of the liquid outlet 46 or the liquid outlets 46, 48 and/or of the atomizer 26 along the flow path F.

Figure 2:
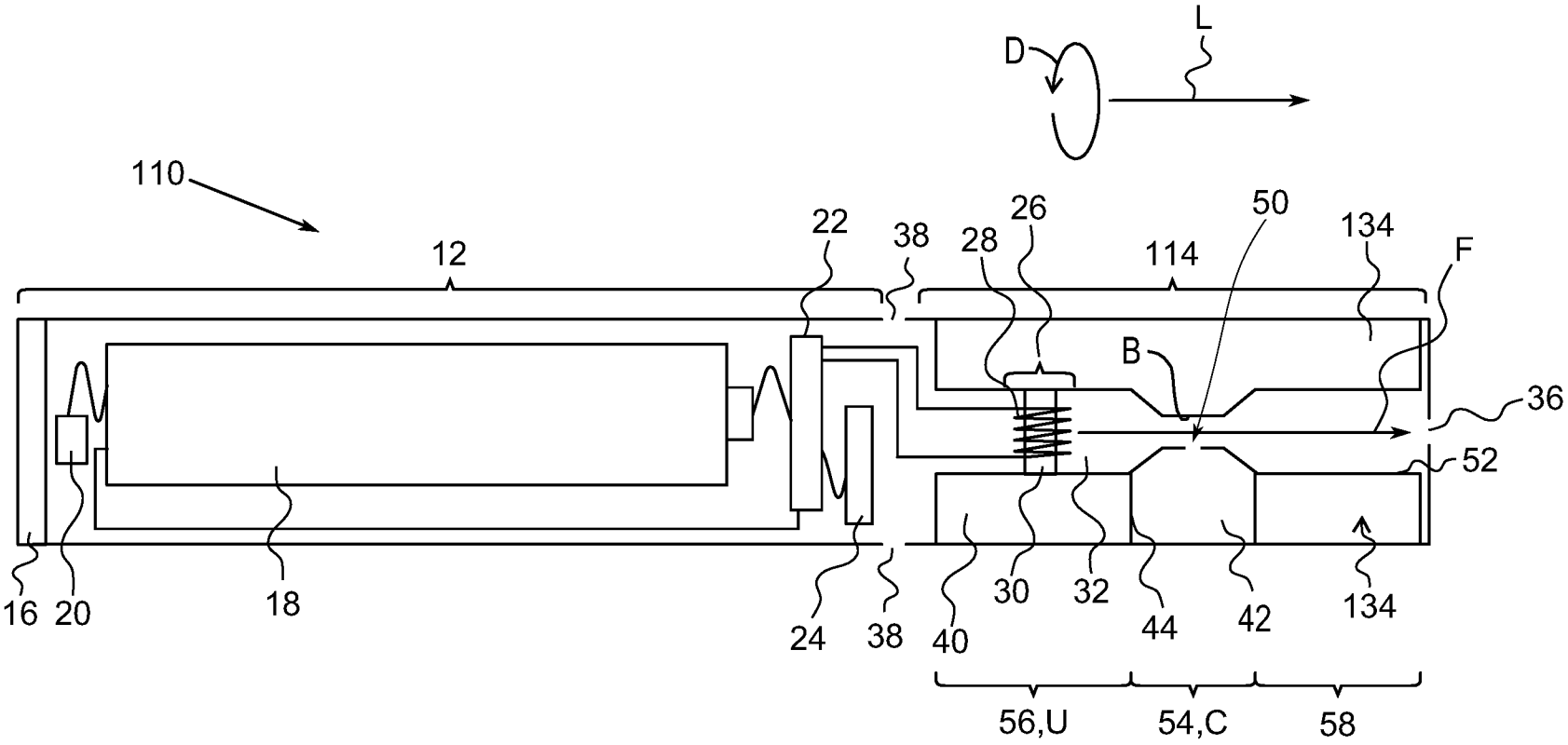
FIG. 2 shows another exemplary embodiment of the electronic smoking device in a schematic cross-sectional view.

FIG. 2 shows another exemplary embodiment of the electronic smoking device with the atomizer/liquid reservoir portion and the liquid reservoir. For the sake of brevity, only differences from the exemplary embodiment of FIG. 1 are looked at.

FIG. 2 shows the liquid reservoir 134 arranged in the atomizer/liquid reservoir portion 114 that, together with the battery portion 12, forms the electronic smoking device 110.

A first section 54 of the lateral surface 52 protrudes from a second section 56 of the lateral surface 52, thereby forming a constricted segment C of the central passage 32. In case a user sucks on the air inhalation port 36, gas flows faster through the constricted segment C than through an unconstricted segment U of the central passage 32, the unconstricted segment U being arranged before the constricted segment C along the flow path F. Thus, within the constricted segment C, reduced pressure exists compared to the pressure in the unconstricted segment C in case gas or aerosol flows along the flow path F towards the air inhalation port 36.

Along the flow path F, a third section 58 of the lateral surface 52 follows the first section 54, from which the first section 54 protrudes. In the area of the second section 56 and in the area of the third section 58, a diameter of the central passage 32 to be measured perpendicular to the longitudinal direction L is essentially the same. Yet, in the area of the first section 52, the diameter perpendicular to the longitudinal direction L of the central passage 32 is reduced.

In case the first section 54 extends around the flow path F in a circumferential direction D of the central passage 32, the circumferential direction D extending perpendicular to the longitudinal direction L, the first section 54 forms a bead B, which symmetrically constricts the central passage 32 in the constricted segment C.

Due to the reduced pressure, additive stored in the second storage volume 42 is drawn out of the second storage volume 42 via the fluid outlet 50.

Figure 3:
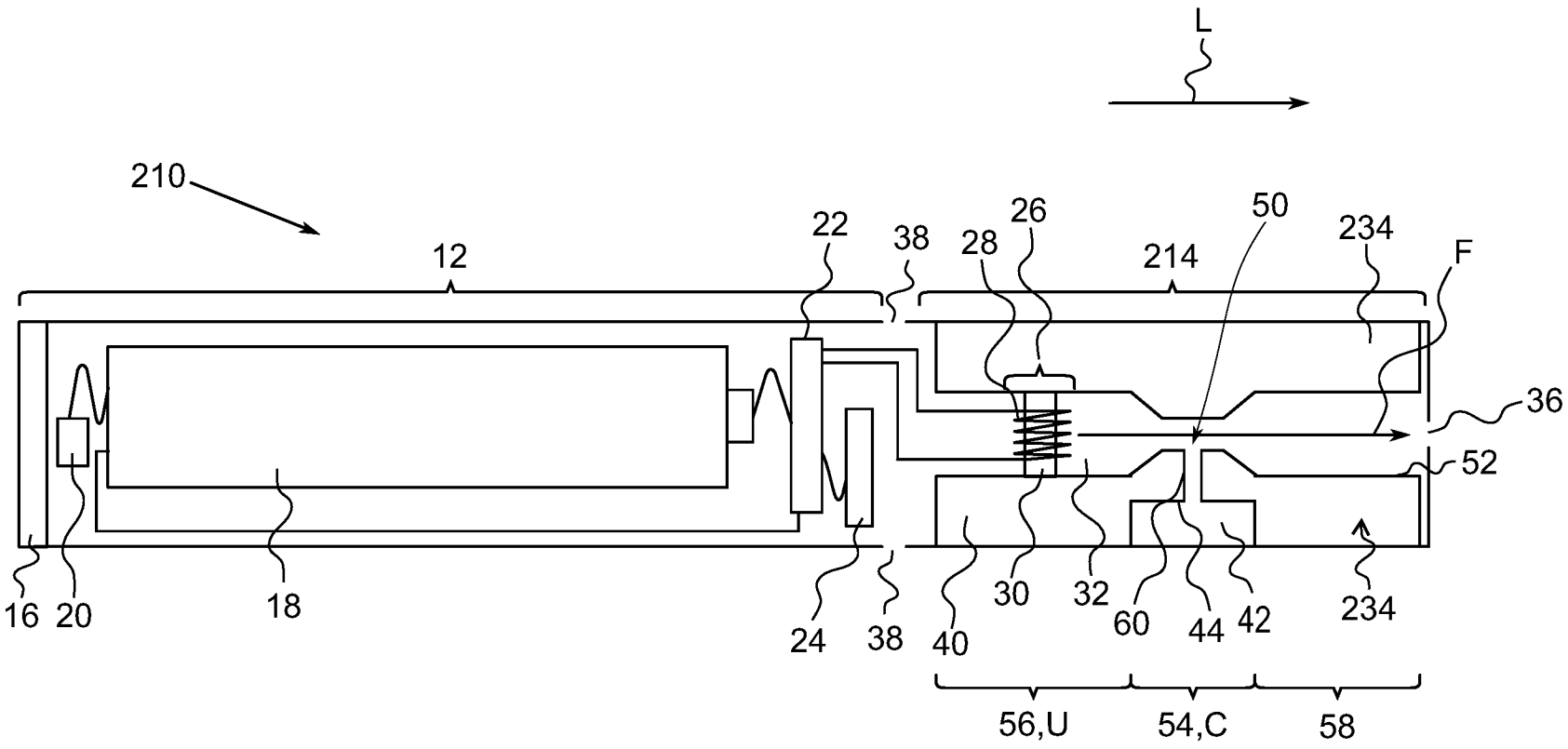
FIG. 3 shows yet another exemplary embodiment of the electronic smoking device in a schematic cross-sectional view.

FIG. 3 shows another exemplary embodiment of the liquid reservoir with the atomizer/liquid reservoir portion and as part of the electronic smoking device schematically in a cross-sectional view. For the sake of brevity, only the differences from the exemplary embodiment of FIG. 2 are looked at.

FIG. 3 shows the liquid reservoir 234 arranged in the atomizer/liquid reservoir portion 214 that, together with the battery portion 12, forms the electronic smoking device 210.

The first storage volume 40 is connected to the fluid outlet 50 by a fluid duct 60. The fluid duct 60 essentially extends perpendicular to the longitudinal direction L.

In summary, in one aspect of the liquid reservoir for an electronic smoking device, the liquid reservoir comprises a first storage and a second storage volume that are separated from each other in a liquid-tight manner, wherein the liquid reservoir comprises a liquid outlet that is adapted to be coupled to an atomizer for an electronic smoking device, the liquid outlet being in communication with the first storage volume, and a fluid outlet that is in communication with the second storage volume, the liquid outlet and the fluid outlet being arranged on the same lateral surface of the liquid reservoir and at a distance to each in a longitudinal direction of the liquid reservoir. In summary, in another aspect, the atomizer/liquid reservoir portion comprises an atomizer for atomizing liquid and a liquid reservoir for storing liquid to be atomized by the atomizer, wherein the liquid reservoir is a liquid reservoir according to the one aspect. In yet another aspect, the electronic smoking device comprises a liquid reservoir according to the one aspect or an atomizer/liquid reservoir portion according to the other aspect.

Hence, an advantage of liquid reservoirs with the first and the second storage volumes, which are each connected to one outlet, namely the liquid outlet and the fluid outlet, may be that different materials can be provided to the user while using the electronic smoking device without previously mixing the materials. The atomizer may be connected to the first storage volume via the liquid outlet in a liquid-transmitting manner, such that the liquid stored in the liquid reservoir can be atomized or vaporized by the atomizer when the electronic smoking device is in use. The material stored in the second storage volume can be provided to the user independent of the atomizer, such that the material stored in the second storage volume is not atomized, e.g. by heating the material. Hence, no thermal changes are applied to the material stored in the second storage volume, the thermal changes potentially being undesired.

The atomizer/liquid reservoir portion may comprise an air inhalation port, wherein the fluid outlet is arranged between the liquid outlet and the air inhalation port along a flow path of the atomized fluid. In particular, the fluid outlet may be arranged between the atomizer and the air inhalation port such that material released from the second storage volume does not contact the atomizer while a user puffs on the electronic smoking device. Hence, an advantage of such an atomizer/liquid reservoir portion may be that the material released from the second storage volume is not unduly heated by the atomizer, such that undesired thermal changes of the material from the second storage volume are avoided.

The liquid reservoir can be a free liquid reservoir, which stores liquid without additional storage material, for example a sponge material or wadding, in its storage volume. Alternatively, the liquid reservoir can comprise additional storage material, for example a sponge material or wadding, in which the liquid is stored.

The lateral surface may define the flow path for the atomized material, wherein the flow path extends to the air inhalation port. Hence, the fluid outlet may be arranged downstream of the liquid outlet and/or of the atomizer along the flow path. An advantage of such a liquid reservoir may be that material released from the fluid outlet while the electronic smoking device is in use does not contact the atomizer and its properties are thus not changed by the atomizer.

A first section of the lateral surface may protrude from a second section of the lateral surface, wherein the fluid outlet is arranged in the first section and the liquid outlet is arranged in the second section. The protruding first section forms a constricted segment in the flow path, such that the liquid reservoir forms a Venturi nozzle, through which the flow path extends. The first section can be arranged between the second a third section of the lateral surface, wherein the first section protrudes from the second and from the third sections.

The atomizer can be arranged before the constricted segment along the flow path, such that, while the electronic smoking device is in use, atomized liquid flows from the atomizer through an unconstricted segment to the constricted segment. An advantage of the constricted segment may be that atomized liquid, aerosol and/or air streams faster than before the unconstricted segment along the flow path, such that a reduced pressure arises in the constricted segment, which causes the material to be drawn out of the second storage volume.

The second storage volume can be a free second storage volume, which stores liquid without additional storage material, for example a sponge material or wadding, being present in the second storage volume. Alternatively, the second storage volume can comprise additional storage material, for example a sponge material or wadding, in which the liquid is stored.

The second storage volume may be connected to the fluid outlet by a fluid duct. The fluid duct can extend perpendicular to the longitudinal direction and can be a straight duct. An advantage of the duct may be that the effects of the Venturi nozzle are improved and the volume of the first storage volume may be increased.

The liquid reservoir may comprise a center through hole that extends along the longitudinal direction, wherein the lateral surface adjoins the center through hole. Thus, as the center through hole may form a central passage for atomized liquid and may end at the air inhalation port of the atomizer/liquid reservoir portion, the form of the flow path can be determined by the center through hole or central passage, i.e. by the liquid reservoir and independent of other components of the atomizer/liquid reservoir portion or of the electronic smoking device. The liquid outlet and the fluid outlet may both open into a center through hole of the liquid reservoir, the center through hole forming a central passage of the atomizer/liquid reservoir portion for atomized liquid.

The first section may form a bead that extends in the circumferential direction and e.g. around a longitudinal axis of the liquid reservoir. The bead extends into the center through hole perpendicular to the longitudinal direction L and may form a rotational symmetrical constricted segment of the flow path, such that the flow velocity of atomized liquid is uniformly increased by the constricted segment. An advantage of such a liquid reservoir may be that condensation of the atomized liquid is reduced.

The first storage volume may comprise a liquid to be atomized by an electronic smoking device, and the second storage volume may comprise a material, e.g. an additive, to be added to the atomized liquid. The liquid to be atomized may be a liquid that forms vapor. Optionally, the liquid to be atomized may comprise nicotine. The material stored in the second storage volume may comprise a flavored material to be mixed with the atomized liquid. Optionally, the nicotine may be present in the material in the second storage volume instead of in the liquid in the first storage volume. An advantage of such a liquid reservoir may be that materials that do not need to be atomized or vaporized can be mixed with the atomized liquid in order to be provided to the user. Atomizing materials may namely affect the materials. For example, the taste of a flavored material may change by atomization or vaporization, in particular due to thermal changes of the material.

The additive may comprise compounds with a volatility higher than water. The compounds may have an evaporation number of less than 10, less than 8, less than 5 or less than 2.5, for example an evaporation number of 8.3. The compounds may have an evaporation rate of more than 3, more than 5, or more than 8, for example an evaporation rate of 3.8.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or the aroma compound of the compounds of the additive may have evaporation numbers between 3.8 and 10. In general, aroma compounds are highly volatile and this is the reason why we can smell them at room temperature. In case the flavor and/or of the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The flavored materials are for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavouring materials, such as anethole, limonene, linalool, eugenol and the like or hydrophilic flavour components such as a leaf tobacco extract or natural plant flavouring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavoured materials as mentioned above into new flavoured materials. Moreover, it is possible to adsorb any flavour onto a solid material and to use this material as flavoured material within an electronic smoking device according to the present. Thus, the invention relates to a liquid reservoir for an electronic smoking device, an atomizer/liquid reservoir portion with a liquid reservoir for an electronic smoking device and to an electronic smoking device with a liquid reservoir. In order to be able to provide gaseous material that has not been atomized by an atomizer of the electronic smoking device, the liquid reservoir comprises first and second storage volumes that are each in communication with a liquid outlet or a fluid outlet, wherein the liquid outlet and the fluid outlet are arranged one after the other in a longitudinal direction of the liquid reservoir.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 110, 210 electronic smoking device
12 battery portion
14, 114, 214 atomizer/liquid reservoir portion
16 end cap
18 battery
20 light emitting diode (LED)
22 control electronics
24 airflow sensor
26 atomizer
28 heating coil
30 wick
32 central passage/center through hole
34, 134, 234 liquid reservoir
36 air inhalation port
38 air inlets
40 first storage volume
42 second storage volume

44 side wall
46, 48 liquid outlet
50 fluid outlet
52 lateral surface of 34
54 first section of 52
56 second section of 52
58 third section of 52
60 fluid duct
A central axis
B bead
C constricted segment
D circumferential direction
F flow path
L longitudinal direction
U unconstructed segment

The invention claimed is:

1. A liquid reservoir for an electronic smoking device, comprising a first storage volume and a second storage volume that are separated from each other in a liquid-tight manner, wherein the liquid reservoir comprises:

a liquid outlet adapted to be coupled to an atomizer of the electronic smoking device, the liquid outlet in communication with the first storage volume;

a fluid outlet in communication with the second storage volume, wherein the fluid outlet is adapted to freely release aerosol from the second storage volume; and wherein the liquid outlet and the fluid outlet are each arranged on a lateral surface of the liquid reservoir and at a distance from each other along a longitudinal direction of the liquid reservoir.

2. The liquid reservoir according to claim 1, wherein the liquid reservoir comprises a central passage that extends along the longitudinal direction, wherein the lateral surface adjoins to the central passage.

3. The liquid reservoir according to claim 2, wherein a first section of the lateral surface protrudes from a second section of the lateral surface, and wherein the fluid outlet is arranged in the first section and the liquid outlet is arranged in the second section.

4. The liquid reservoir according to claim 3, wherein the first section forms a bead that extends around a longitudinal axis of the liquid reservoir and into the central passage.

5. The liquid reservoir according to claim 3, wherein the first section is arranged between the second section and a third section of the lateral surface and protrudes from the second and the third sections.

6. The liquid reservoir according to claim 1, wherein the second storage volume is connected to the fluid outlet by a fluid duct.

7. The liquid reservoir according to claim 1, wherein the first storage volume comprises a liquid to be atomized by the electronic smoking device, and the second storage volume comprises an additive to be added to the atomized liquid.

8. The liquid reservoir according to claim 7, wherein the additive comprises compounds with a volatility higher than water.

9. The liquid reservoir according to claim 8, wherein the additive comprises a flavored material and/or nicotine.

10. An atomizer/liquid reservoir portion comprising an atomizer for atomizing liquid, and a liquid reservoir for storing liquid to be atomized by the atomizer, wherein the liquid reservoir comprises:

a first storage volume and a second storage volume that are separated from each other in a liquid-tight manner;

a liquid outlet adapted to be coupled to the atomizer, the liquid outlet in communication with the first storage volume;

a fluid outlet in communication with the second storage volume, wherein the fluid outlet is adapted to freely release aerosol from the second storage volume; and wherein the liquid outlet and the fluid outlet are each arranged on a lateral surface of the liquid reservoir and at a distance from each other along a longitudinal direction of the liquid reservoir.

11. The atomizer/liquid reservoir portion according to claim 10, wherein the atomizer/liquid reservoir portion comprises an air inhalation port, wherein the fluid outlet is arranged between the atomizer and the air inhalation port.

12. The atomizer/liquid reservoir portion according to claim 11, wherein the lateral surface defines a flow path for atomized liquid, and wherein the flow path extends to the air inhalation port and the fluid outlet is arranged downstream of the liquid outlet or of the atomizer along the flow path.

13. The atomizer/liquid reservoir portion according to claim 11, wherein the liquid reservoir comprises a central passage that extends along the longitudinal direction, wherein the lateral surface adjoins to the central passage, and wherein the central passage is a central through hole.

14. An electronic smoking device comprising:

a liquid reservoir including:

a first storage volume and a second storage volume that are separated from each other in a liquid-tight manner;

a liquid outlet adapted to be coupled to an atomizer of the electronic smoking device, the liquid outlet in communication with the first storage volume;

a fluid outlet in communication with the second storage volume, wherein the fluid outlet is adapted to freely release aerosol from the second storage volume; and wherein the liquid outlet and the fluid outlet are each arranged on a lateral surface of the liquid reservoir and at a distance from each other along a longitudinal direction of the liquid reservoir.

15. The electronic smoking device of claim 14, wherein a first section of the lateral surface protrudes from a second section of the lateral surface, and wherein the fluid outlet is arranged in the first section and the liquid outlet is arranged in the second section.

16. The electronic smoking device of claim 15, wherein the first section is arranged between the second section and a third section of the lateral surface and protrudes from the second and the third sections.

17. The electronic smoking device of claim 14, wherein the liquid reservoir is an atomizer/liquid reservoir portion further comprising the atomizer configured to atomize liquid.

18. The electronic smoking device of claim 17, wherein the atomizer/liquid reservoir portion comprises an air inhalation port, wherein the fluid outlet is arranged between the atomizer and the air inhalation port.

19. The electronic smoking device of claim 18, wherein the lateral surface defines a flow path for atomized liquid, and wherein the flow path extends to the air inhalation port and the fluid outlet is arranged downstream of the liquid outlet of the atomizer along the flow path.

20. The electronic smoking device of claim 18, wherein the liquid reservoir comprises a central passage that extends along the longitudinal direction, wherein the lateral surface adjoins to the central passage, and wherein the central passage is a central through hole.

* * * * *